US007963230B2

(12) United States Patent
Simpson et al.

(10) Patent No.: US 7,963,230 B2
(45) Date of Patent: Jun. 21, 2011

(54) SHIELD ASSEMBLY FOR RAILROAD TANK CAR

(75) Inventors: Ernie Simpson, Nicholasville, KY (US); Noel Rush, Louisville, KY (US)

(73) Assignee: R.J. Corman Derailment Services, LLC, Nicholasville, KY (US)

( * ) Notice: Subject to any disclaimer, the term of this patent is extended or adjusted under 35 U.S.C. 154(b) by 604 days.

(21) Appl. No.: 11/836,235

(22) Filed: Aug. 9, 2007

(65) Prior Publication Data

US 2008/0035015 A1 Feb. 14, 2008

Related U.S. Application Data

(60) Provisional application No. 60/837,452, filed on Aug. 11, 2006.

(51) Int. Cl.
*B61D 5/00* (2006.01)

(52) U.S. Cl. ..... 105/358; 414/592

(58) Field of Classification Search ..... 105/394, 105/378, 358, 360, 359, 362; 410/68; 414/592, 414/594, 611, 612, 618, 621, 624, 626, 754, 755, 756, 783

See application file for complete search history.

(56) References Cited

U.S. PATENT DOCUMENTS

| | | | | |
|---|---|---|---|---|
| 1,367,976 | A * | 2/1921 | Jacobson | 294/74 |
| 3,876,739 | A * | 4/1975 | Loveland | 264/46.4 |
| 3,971,491 | A * | 7/1976 | Mowatt-Larssen et al. | 220/647 |
| 3,994,239 | A | 11/1976 | Baker et al. | |
| 4,223,612 | A | 9/1980 | Polley | |
| 4,407,203 | A | 10/1983 | Harbin et al. | |
| 4,466,356 | A | 8/1984 | Messersmith et al. | |
| 4,525,490 | A * | 6/1985 | Smith | 521/124 |
| 4,557,199 | A | 12/1985 | Everett, Jr. | |

* cited by examiner

*Primary Examiner* — Mark T Le
(74) *Attorney, Agent, or Firm* — King & Schickli, PLLC

(57) ABSTRACT

A shield for protecting an exterior wall of a railroad car during a lifting operation includes a body having a first face for engaging that exterior wall. The first face may have a radius of curvature to substantially match the radius of curvature of the tank car.

19 Claims, 5 Drawing Sheets

SHIELD ASSEMBLY FOR RAILROAD TANK CAR

This application claims the benefit of U.S. Provisional Application No. 60/837,452 filed Aug. 11, 2006, the disclosure of which is incorporated herein by reference.

TECHNICAL FIELD

The present invention relates generally to the field of railroading and, more particularly, to a shield, shield assembly, and method for protecting an exterior wall of a railroad tank car during a lifting or rerailing operation.

BACKGROUND OF THE INVENTION

The accidental derailing of railroad cars occurs with some frequency. Many such derailments occur in rail yards at low speeds. Under these conditions the derailed car often remains upright and relatively undamaged. The rerailment of such a derailed car requires the lifting of the car with a hoist or the like and the setting of the wheels of the derailed truck or trucks back on the track.

A railroad tank car typically includes a tank having an inner shell for holding a commodity, an outer shell or exterior wall and a layer of insulation in between. The tank is typically supported on two bolsters connected to an underframe. Each bolster overlies a truck assembly including a series of track engaging wheels.

Railroad tank cars have generally been designed without consideration given to derailment handling. Thus, unfortunately, many tank cars are significantly damaged during retailing. More specifically, the hoist is typically connected to a lift point on the bolster of the rail car. The outer shell of the tank typically extends to the side up to or beyond this point. Accordingly, as the car is lifted, the hook or rigging of the hoist engages the outer shell of the tank often exerting a pressure that ruptures the shell or exterior wall, thereby producing serious damage to the car that is very expensive to repair. The present invention addresses this problem and protects the exterior wall of the tank car from rupturing during the lifting and rerailing operation.

SUMMARY OF THE INVENTION

In accordance with the purposes of the present invention as described herein, a shield is provided for protecting an exterior wall of a railroad tank car during a lifting operation where that exterior wall has a radius of curvature R. The shield comprises a body have a first face for engaging the exterior wall. The first face has a radius of curvature of substantially R. The first face may also include a resilient liner made from rubber, plastic, spray foam or other appropriate material. The body is typically formed from ¾ inch thick steel and has a radius of curvature R of between about 30.0 and about 95.0 inches and more typically is equal to substantially 63.25 inches.

In addition the body includes an outer face opposite the first face. A first lift element is provided along a center line of the outer face. In addition a pair of second lift elements is provided on the outer face. One second lift element is provided an equal distance from the center line on each side of the outer face.

In accordance with an additional aspect of the present invention a shield assembly is provided for protecting an exterior wall of a railroad tank car during a lifting operation. The shield assembly comprises a first body having a first face for engaging an exterior wall along a first side of the tank, a second body having a second face for engaging the exterior wall along a second side of the tank, and a tether connecting the first body and the second body in a manner allowing the shield assembly to lay over the tank of the tank car. The first lace and second face have a radius curvature of between about 30.0 and about 95.0 inches and more typically about 63.25 inches. That radius of curvature substantially matches the radius of curvature R of the exterior wall of the tank of the tank car.

Still further a resilient liner is provided on the first and second faces. The resilient liner may be made of rubber, plastic, spray foam or a mixture or combination thereof. The first and second bodies include an outer face and a first lift element is provided along a center line of the outer face of each of those bodies. The first lift element may be a chain secured to each of the first and second bodies at two points adjacent the center line. Still further each of the first and second bodies include a pair of second lift elements provided an equal distance from the center line on each side of the outer face. A tether is connected to the second lift elements. The tether comprises a pair of chains. The pair of chains include a mechanism to allow for length adjustment.

In accordance with yet another aspect of the present invention a method is provided for protecting an exterior wall of a tank while lifting the tank car. The method comprises connecting a hoist to the tank car and providing a shield between the exterior wall of the tank and any element or rigging of the hoist that would otherwise engage that exterior wall during the lifting operation. Described alternatively, the method includes the steps of placing a shield assembly over the exterior wall of the tank of the tank car, attaching at least one hoist to the tank car so that the shield is between the exterior wall and any element or rigging of the hoist that would otherwise engage the exterior wall and lifting the tank car with the hoist.

In the following description there is shown and described preferred embodiments of this invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporating in and forming a part of the specification, illustrate several aspects of the present invention and together with the description serve to explain certain principals of the invention. In the drawings.

Reference will now be made in detail to the presently preferred embodiments of the invention, examples of which are illustrated in the accompanying drawings.

DETAILED DESCRIPTION OF THE INVENTION

Figure 1:
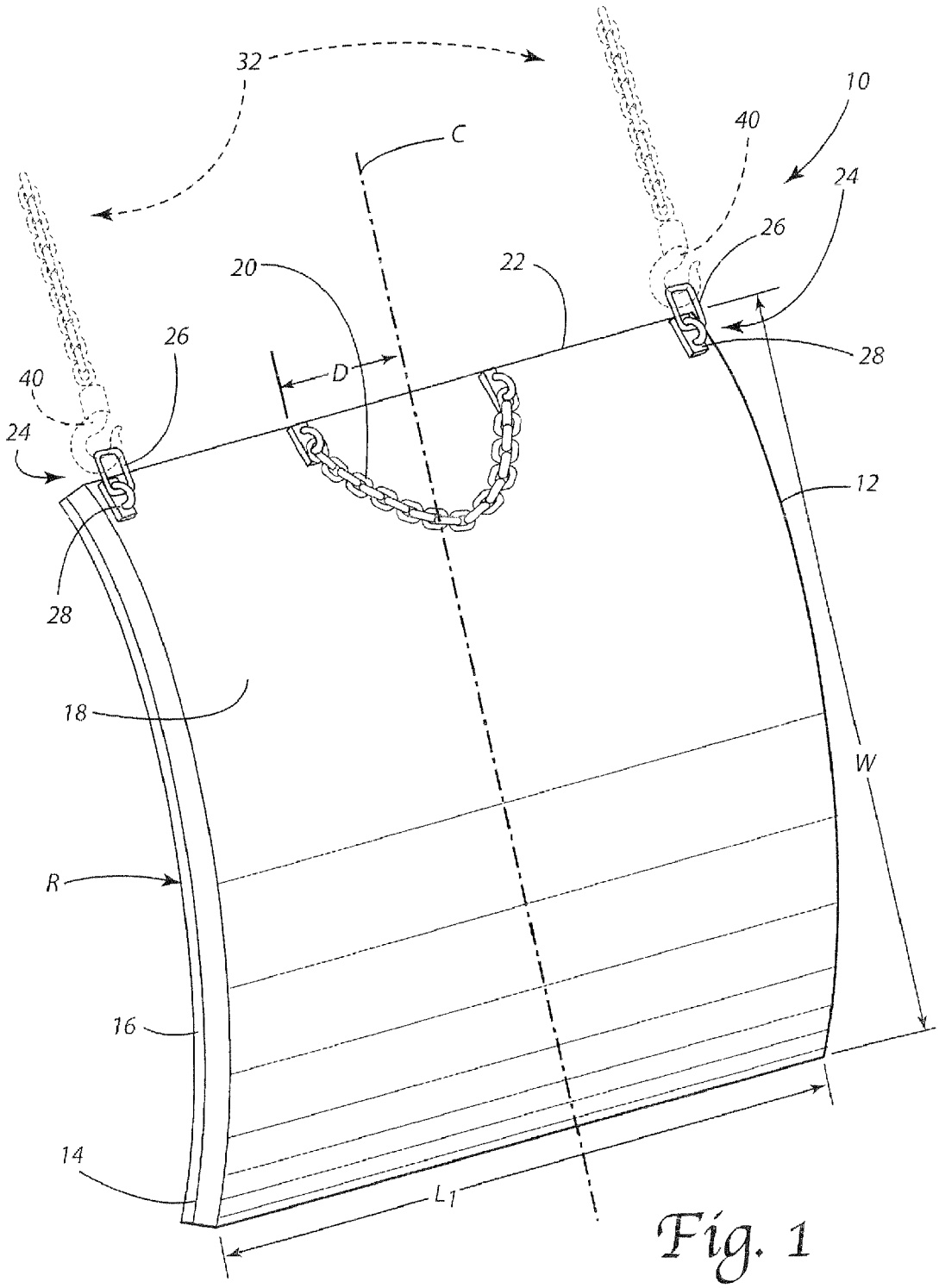
FIG. 1 is a perspective view of one embodiment of the shield of the present invention.

Reference is now made to Exhibit A, herein incorporated by reference, and FIG. 1 illustrating the shield 10 of the present invention. As illustrated the shield 10 includes a body 12 made from ¾ inch thick steel or other appropriate high strength material. The body 12 has a radius of curvature R of between about 30.0 and about 95.0 inches and is typically about 63.25 inches. The radius of curvature R is selected to match or closely correspond to the radius of curvature of the exterior wall or skin of a tank of a railroad tank car.

Typically, the body 12 has a width W of between about 6 inches and about 72 inches and a length $L_1$ of between about 6 inches and about 72 inches. Preferably, the width W is about 48 inches and the length $L_1$ is about 60 inches. This provides a surface area of between about 36 sq. inches and about 5184 sq. inches and most typically about 2880 sq. inches. However, one will appreciate that the body 12 may have any width W, length $L_1$, and surface area.

The body 12 includes a first or inner face 14 that is covered with or carries a resilient liner 16. The resilient liner 16 may be formed from a layer of material selected from a group consisting of rubber, plastic, spray foam and mixtures thereof. The resilient liner 16 typically has a thickness at rest of between about ⅛ inch and about ½ inch. As further illustrated in FIG. 1, the body 12 includes an outer face 18 opposite the first or inner face 14. A first lift element 20 is provided along a center line C of the shield 10 on the outer face 18. In the illustrated embodiment the first lift element 20 comprises a chain having both ends welded or otherwise connected to the body 12. More specifically, one end is connected a distance D to one side of the center line C while the second end is connected the same distance D to the other side of the center line C. Both connection points are the same distance from the upper edge 22 of the shield 10. This placement allows the shield 10 to be in balance when lifted by the lift element 20.

As further illustrated in FIG. 1 a pair of second lift elements 24 are secured to the outer lace 18 of the shield 10. More specifically, one second lift element 24 is provided an equal distance from the center line C on each side of the outer face 18 and both second lift elements are provided the same distance from the upper edge 22. As illustrated in detail in FIG. 1, the second lift elements 24 comprise lift rings 26 that engage brackets 28 secured to the body 12 by welding or other means. Alternatively, but not shown, each of the second lift elements 24 may comprise a mounting tube that is welded or otherwise secured by brackets and fasteners to the shield 10 and a lift ring that is pivotably mounted to each mounting tube.

Figure 2:
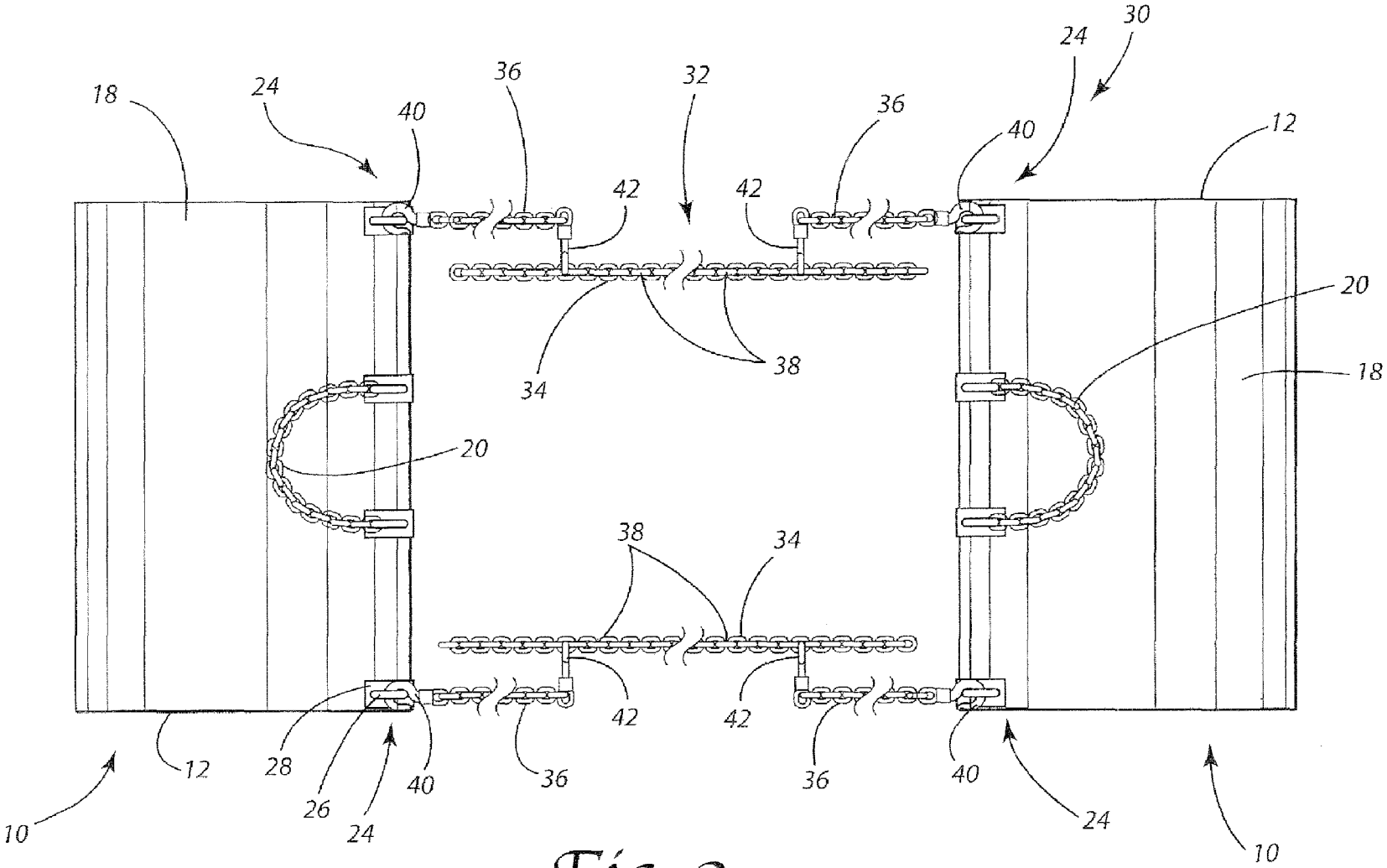
FIG. 2 is a top plan view of one embodiment of the shield assembly of the present invention.

The shield assembly 30 of the present invention is illustrated in FIG. 2. The shield assembly 30 generally comprises two shields 10 as previously described and illustrated in FIG. 1 connected together by means of a tether, generally designated by reference numeral 32. More specifically, the tether 32 comprises a pair of lines 34 illustrated as chains. As noted, one line 34 is connected between a first of a pair of second lift elements 24 on the two shields 10 while the other line is connected to a second of a pair of second lift elements on the two shields. Substantially any appropriate mechanism known in the art for allowing adjustment of the length of the lines may also be included as a part of the tether 32. In the illustrated embodiment the length adjustment is provided by forming each line 34 from a pair of connecter chains 36 and an intermediate chain 38. Each connector chain includes a first hook 40 for engaging one of the second lift elements 24 and a second hook 42 for engaging a link of the intermediate chain 38. By engaging different links of the intermediate chain 38 with the second hook 42, it is possible to lengthen or shorten the line 34. In this way it is possible to adjust the height of the shields 10 along the sides of a tank car in a manner that will be described in greater detail below.

Figure 3:
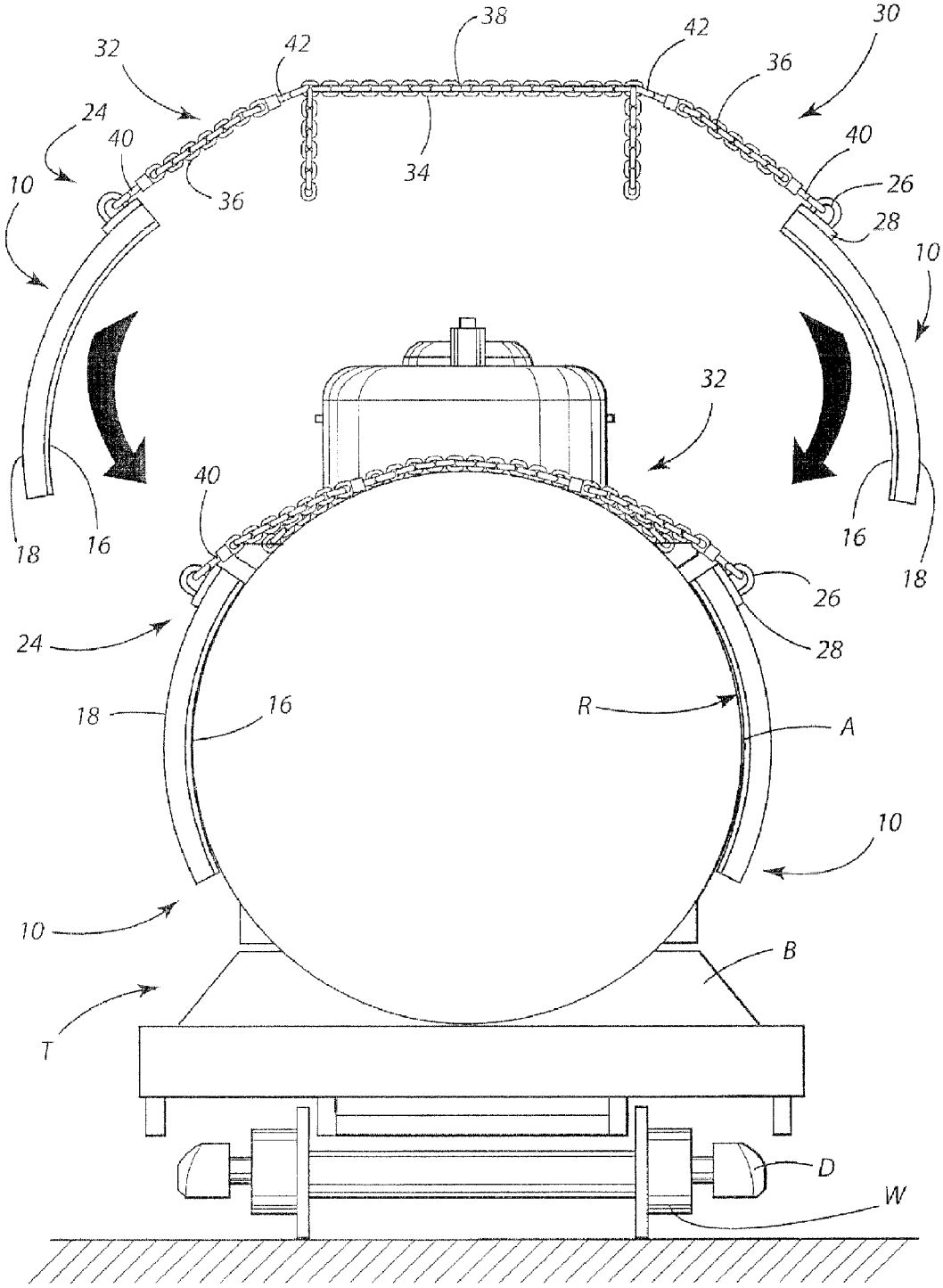
FIG. 3 is an end elevational view showing how a shield assembly is positioned over the top of a derailed railroad tank car.
Figure 4:
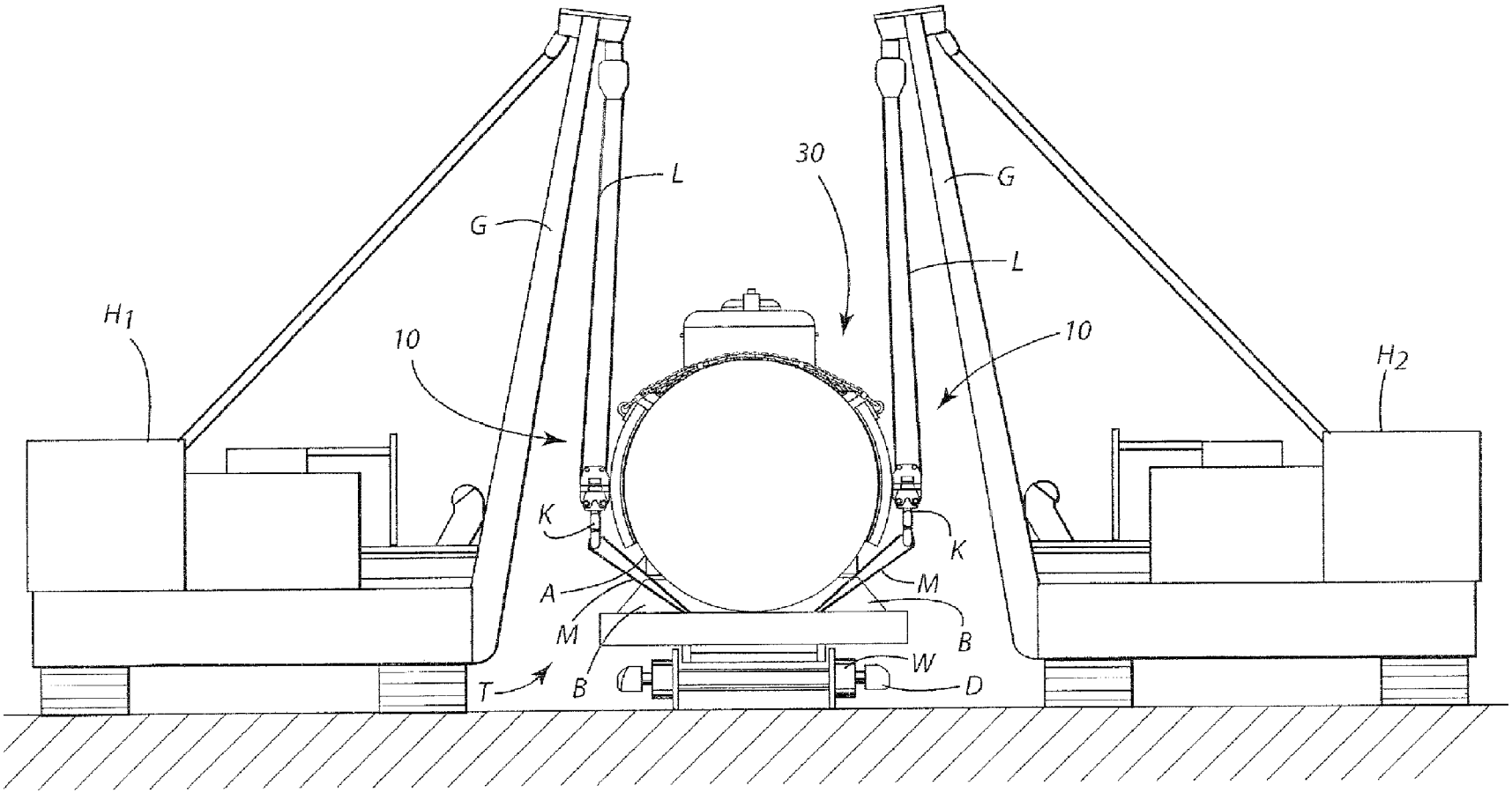
FIG. 4 is an end view similar to FIG. 3 showing how the shields protect the exterior wall or outer skin of the tank car from damage as hoists are used to raise the tank car during the rerailing operation.

As best illustrated in FIGS. 3 and 4, the shield assembly 30 may be used to protect the exterior wall of a tank A when lifting a railroad tank car T such as during a rerailing operation. As illustrated, tank car T includes a tank A supported at each end on a bolster B over a truck assembly D that carries the wheels W that ride over the rails. As illustrated in FIG. 3, the shield assembly 30 is placed over the body of the tank A, like a saddle is placed over a horse, with the shields 10 at each end thereof resting along the sides or flanks of the tank A. The length of the lines 34 are adjusted as necessary by means of the connector chains 36 in order to allow the shields 10 to rest in the proper position along the flanks of the tank A. A hoist $H_1$, $H_2$ or other piece of equipment may be utilized to raise either or both of the shields 10 by means of the first lift element 20 in order to take the weight of the shields off the lines 34 to allow length adjustment by connecting the second hooks 42 with different links of the intermediate chain 38. The shields 10 are then lowered by the hoists $H_1$, $H_2$ until they are again supported by the lines 34.

As best illustrated in FIG. 4, a hoist $H_1$, $H_2$ is provided on each side of the tank car T. The hoist $H_1$ or $H_2$ includes a boom G for supporting a line L connected to a hook K. The hook K on the first hoist $H_1$ is connected by means of a cable M to the bolster B on one side of the tank car T while the hook K on the second hoist $H_2$ is connected by means of a cable M to the bolster B on the other side of the tank car. As the line L is taken up to remove the slack, of each hoist, $H_1$, $H_2$, the hooks K engage the shields 10 at each side of the tank car T. The shields 10 are provided between the exterior wall of the tank A and the hooks K to spread the pressure exerted by the hooks on the exterior wall of the tank over the entire surface area of the shields and prevent the hooks A from rupturing or even significantly denting or deforming that wall. The lines L of the hoist $H_1$ and $H_2$ are then taken up as necessary to lift the end of the tank car T and then move the tank car so as to replace the wheels W of the truck assembly D onto the rails. This same procedure is performed at the opposite end of the tank car if in fact that end is also derailed. In this way rerailing may be completed without damaging the wall of the tank A which would otherwise require possibly extensive and certainly expensive repair.

Figure 5:
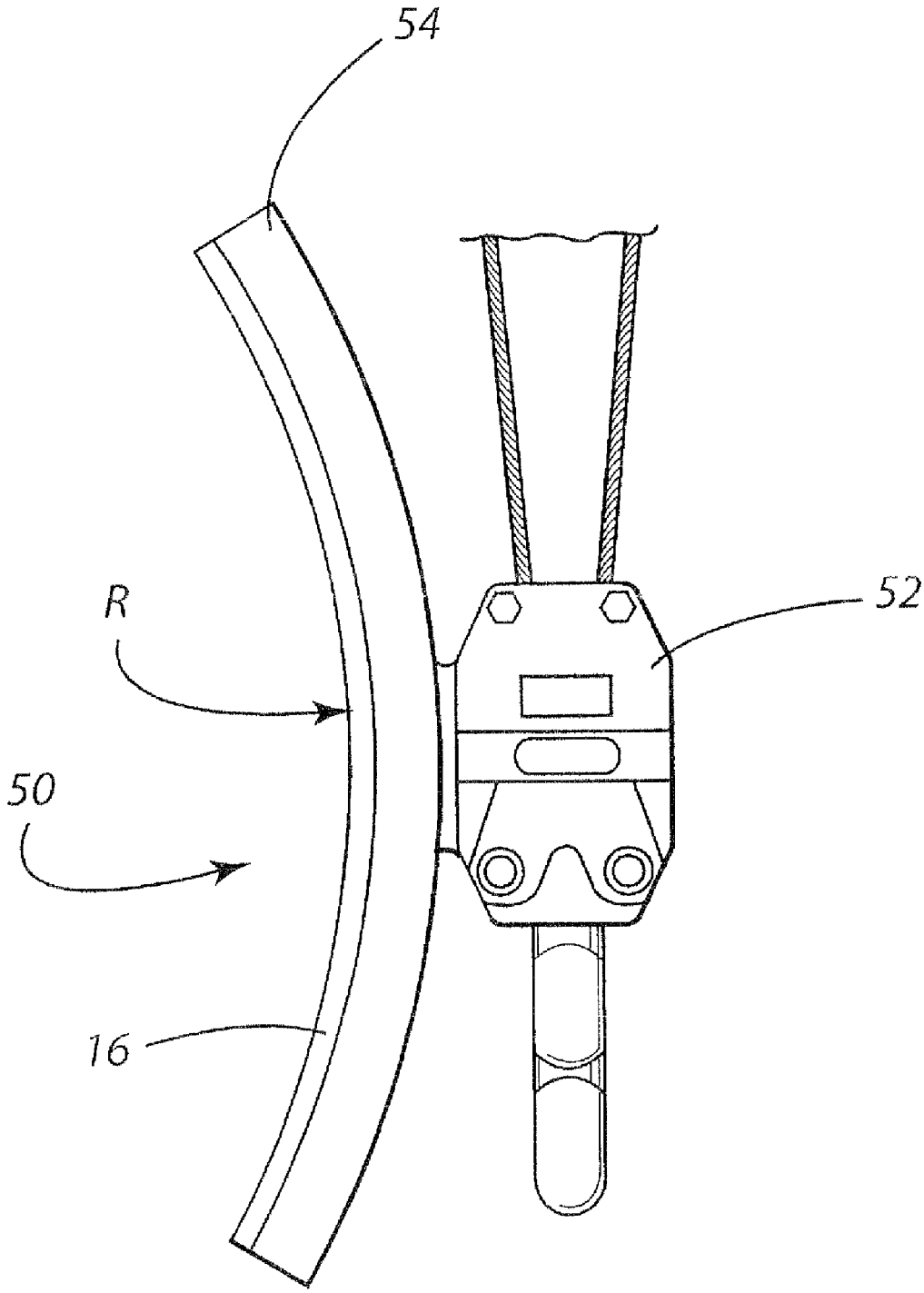
FIG. 5 is a side elevational view showing an alternative embodiment of the present invention wherein a shield is attached directly to the hoist hook.

An alternative embodiment of the present invention is illustrated in FIG. 5. In this embodiment a shield 50 is secured by welding directly to the side of the hoist hook 52. This shield 50, like the shield 10, includes a body 54 having an appropriate radius of curvature R for substantially matching the radius of curvature of the tank A on the tank car T. The inner face of the shield 50 may also incorporate a resilient liner 16 in the same manner as the shield 10. While the shield 50 is mounted to the hoist hook 52 by welding in the illustrated embodiment, it should be appreciated that the shield 50 may also be mounted by means of a bracket and cooperating fasteners or other appropriate means if desired.

The foregoing description of several preferred embodiments of the invention have been presented for purposes of illustration and description. It is not intended to be exhaustive or to limit the invention to the precise form disclosed. Obvious modifications or variations are possible in light of the above teachings. For instance, the body 12 may be made from any material of any shape and size. The body 12 may also be any number of pieces of material joined in any manner. The first lift element 20 may have any configuration and be attached to the body in any manner. Also, the body 12 may be provided without the first lift element 20. Similarly, the tether 32 may have any configuration and be any number of pieces. The embodiments were chosen and described to provide the best illustration of the principals of the invention in its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed:

1. A shield assembly protecting an exterior wall of a railroad tank car during a lifting operation where said exterior wall has a radius of curvature R, said shield assembly comprising:

a first shield body, a second shield body and a tether connecting said first and second shield bodies together;

said shield assembly having an operative position with:

said first shield body having a first face engaging said exterior wall, said first face having a radius of curvature of substantially R, wherein said first face comprises an exterior surface of said first shield body;

said second shield body having a second face engaging said exterior wall, said second face having a radius of curvature of substantially R wherein said second face comprises an exterior surface of said second shield body;

said tether straddling a top of said tank car and said first and second shield bodies engaging said exterior wall at opposite sides where said first and second shield bodies are positioned between a lifting device and said external wall of said tank car;

said shield assembly being further characterized by:

a resilient liner attached to each of said first face and said second face, said resilient liner being positioned between said first face and said railroad tank car and said second face and said tank car so that said resilient liner directly contacts said railroad tank car.

2. The shield assembly of claim 1, wherein each of said first and second shield bodies are formed from ¾ inch thick steel and said first and second faces each have a surface area of between about 36 sq. inches and about 5184 sq. inches.

3. The shield assembly of claim 1, wherein R is between about 30.0 inches and about 95.0 inches.

4. The shield assembly of claim 1, wherein R is equal to substantially 63.25 inches.

5. The shield assembly of claim 1, wherein said resilient liner is formed from a layer of material selected from a group consisting of rubber, plastic, spray foam and mixtures thereof having a thickness at rest of between about ⅛ inch and about ½ inch.

6. The shield assembly of claim 1, wherein each of said first and second shield bodies includes an outer face opposite said first face and a first lift element is provided along a centerline of said outer face.

7. The shield assembly of claim 6, further including a pair of second lift elements provided on said outer face.

8. The shield assembly of claim 7, wherein each one of said second lift elements is provided an equal distance from said centerline on said outer face.

9. An arrangement for protecting a railroad tank car, comprising:

a railroad tank car having an exterior wall;

a first body having a first face for engaging said exterior wall along a first portion of said tank car;

a second body having a second face for engaging said exterior wall along a second portion of said tank car; and a tether connecting said first body and said second body together and said tether straddling a top of said tank car and holding (1) said first body between a lifting device and a first side of said tank care and (2) said second body between said lifting device and a second side of said tank car.

10. The arrangement of claim 9, wherein said first face and said second face have a radius of curvature of between about 30.0 inches and about 95.0 inches.

11. The arrangement of claim 10, wherein said radius of curvature substantially matches a radius of curvature R of said exterior wall.

12. The arrangement of claim 9, wherein said first and second faces include a resilient liner.

13. The arrangement of claim 12, wherein said resilient liner is made of a material selected from a group consisting of rubber, spray foam, plastic and mixtures thereof.

14. The arrangement of claim 9, wherein said first and second bodies include an outer face and a first lift element is provided along a centerline of said outer face of each of said first and second bodies.

15. The arrangement of claim 14, wherein said first lift element is a chain secured to each of said first and second bodies at two points adjacent said centerline.

16. The arrangement of claim 14, wherein each of said first and second bodies include a pair of second lift elements provided an equal distance from said centerline on each side of said outer face.

17. The arrangement of claim 16, wherein said tether is connected to said second lift elements.

18. The arrangement of claim 17, wherein said tether comprises a pair of lines made from chains or cables.

19. The arrangement of claim 18, wherein said pair of lines are length adjustable.

* * * * *